US010420415B1

(12) United States Patent
Wallace

(10) Patent No.: US 10,420,415 B1
(45) Date of Patent: Sep. 24, 2019

(54) CONTAINER CARRYING SYSTEM

(71) Applicant: David A. Wallace, Craig, CO (US)

(72) Inventor: David A. Wallace, Craig, CO (US)

( * ) Notice: Subject to any disclaimer, the term of this patent is extended or adjusted under 35 U.S.C. 154(b) by 0 days.

(21) Appl. No.: 15/956,517

(22) Filed: Apr. 18, 2018

(51) Int. Cl.

| | |
|---|---|
| ***A45F 3/14*** | (2006.01) |
| ***A45F 5/10*** | (2006.01) |
| ***A45F 3/02*** | (2006.01) |
| ***A45F 5/00*** | (2006.01) |
| ***A45F 3/12*** | (2006.01) |

(52) U.S. Cl.
CPC ..... *A45F 3/14* (2013.01); *A45F 3/02* (2013.01); *A45F 3/12* (2013.01); *A45F 5/00* (2013.01); *A45F 5/1026* (2013.01); *A45F 2003/142* (2013.01); *A45F 2003/148* (2013.01)

(58) Field of Classification Search
CPC ..... A45F 3/14; A45F 3/102; A45F 3/1026; A45F 5/102; A45F 5/1026; Y10S 224/925
USPC ..... 224/257, 258, 259, 262, 925; D3/327
See application file for complete search history.

(56) References Cited

U.S. PATENT DOCUMENTS 741,098 A * 10/1903 Bibler ..... A45C 13/38 224/260
2,718,988 A * 9/1955 Potts ..... A45F 5/00 224/231
3,181,752 A * 5/1965 Seltzer ..... A45C 13/38 224/260
3,258,788 A * 7/1966 Anciaux ..... A45F 3/14 182/3
4,699,415 A * 10/1987 Skovajsa ..... A63C 11/025 224/257
4,930,695 A * 6/1990 Thompson ..... G10G 5/005 224/257
5,361,956 A * 11/1994 Recanati ..... A45F 3/14 224/257
D362,622 S * 9/1995 Van Davelaar ..... 294/137
5,487,581 A * 1/1996 Carmo ..... A45F 5/1026 294/137
D400,785 S * 11/1998 Randall ..... D9/434
6,045,019 A * 4/2000 Moses ..... A45F 3/14 224/257
6,247,739 B1 * 6/2001 Lyon ..... A45F 5/1026 294/137
D455,348 S * 4/2002 Fludd ..... 294/137
D457,725 S * 5/2002 Parsons ..... D3/327
6,499,781 B1 * 12/2002 Flynn ..... A45F 3/10 294/159
6,698,544 B2 * 3/2004 Kurtgis ..... A62B 35/0075 182/145
D508,323 S * 8/2005 Douglas ..... D3/328
6,923,356 B2 * 8/2005 Reynolds ..... A45F 3/14 224/254
D544,211 S * 6/2007 Herzberg ..... D3/327
7,328,925 B1 * 2/2008 Jenkins ..... A45F 5/1026 294/137
D567,649 S * 4/2008 Borkowski ..... D9/434
D593,411 S * 6/2009 Bizzell ..... D9/434
D595,130 S * 6/2009 Bizzell ..... D9/434
(Continued)

*Primary Examiner* — Justin M Larson
(74) *Attorney, Agent, or Firm* — Craig R. Miles; CR Miles P.C.

(57) ABSTRACT

A device and methods in the device including at least one flexible annular member coupled to at least one hook element which can be worn by a person to couple one or more containers to the hook element to reduce effort in transport of the containers.

13 Claims, 7 Drawing Sheets

(56) References Cited

U.S. PATENT DOCUMENTS

| | | | | |
|---|---|---|---|---|
| D598,732 | S * | 8/2009 | Bizzell | D8/356 |
| 8,225,971 | B2 * | 7/2012 | Stark | A45C 13/38 224/255 |
| 9,826,817 | B2 * | 11/2017 | Whitehill | A45F 3/04 |
| 2004/0084490 | A1 * | 5/2004 | Caputi | A45C 13/30 224/257 |
| 2004/0201236 | A1 * | 10/2004 | Adelson | A45F 5/1026 294/159 |
| 2005/0044662 | A1 * | 3/2005 | Yu | A45F 5/102 16/110.1 |
| 2006/0178250 | A1 * | 8/2006 | Findon | A45F 5/1026 493/221 |
| 2007/0108241 | A1 * | 5/2007 | Bass | A45F 5/00 224/162 |
| 2007/0175940 | A1 * | 8/2007 | Sacks | A45F 3/14 224/579 |
| 2009/0032559 | A1 * | 2/2009 | Fragale | A45F 5/1026 224/255 |
| 2009/0188955 | A1 * | 7/2009 | Bizzell | A45F 3/14 224/258 |
| 2010/0187274 | A1 * | 7/2010 | Chock, Jr. | B63B 35/7946 224/578 |
| 2011/0049203 | A1 * | 3/2011 | Stark | A45C 13/38 224/255 |
| 2012/0145756 | A1 * | 6/2012 | Fuller | A45F 3/14 224/257 |
| 2015/0048638 | A1 * | 2/2015 | Manasharov | A45F 5/1026 294/158 |
| 2016/0183666 | A1 * | 6/2016 | Whitehill | A45F 3/02 224/578 |

* cited by examiner

CONTAINER CARRYING SYSTEM

I. FIELD OF THE INVENTION

A device and methods in the device including at least one flexible annular member coupled to at least one hook element which can be worn by a person to couple one or more containers to the hook element to reduce effort in transport of the containers.

II. SUMMARY OF THE INVENTION

Accordingly, a broad object of the invention can be to provide a device having at least one hook element including: an elongate member having a first end and a second end, the first end of the elongate member medially coupled to a cross member, and the second end of the elongate member medially coupled to a prong element, the prong element having a first prong end opposite a second prong end, each of the first and second prong ends extending toward the cross member.

Another broad object of the invention can be to provide a method of making a device including configuring at least one hook element, including obtaining an elongate member having a first end and a second end, medially coupling the first end of the elongate member to a cross member, and medially coupling the second end of the elongate member to a prong element having a first prong end opposite a second prong end, each of the first and second prong ends extending toward the cross member.

Another broad object of the invention can be to provide a method of using a device including obtaining a device having at least one hook element including an elongate member having a first end and a second end, the first end of the elongate member medially coupled to a cross member and the second end of the elongate member medially coupled to a prong element, the prong element having a first prong end opposite a second prong end, each of the first and second prong ends extending toward the cross member, an aperture element disposed in the cross member, and at least one flexible annular member passing through the aperture element, disposing the at least one flexible annular member about a part of the body or an object, and disposing a handle of a container on the hook element.

Naturally, further objects of the invention are disclosed throughout other areas of the specification, drawings, photographs, and claims.

III. BRIEF DESCRIPTION OF THE DRAWINGS

IV. DETAILED DESCRIPTION OF THE INVENTION

Figure 1:
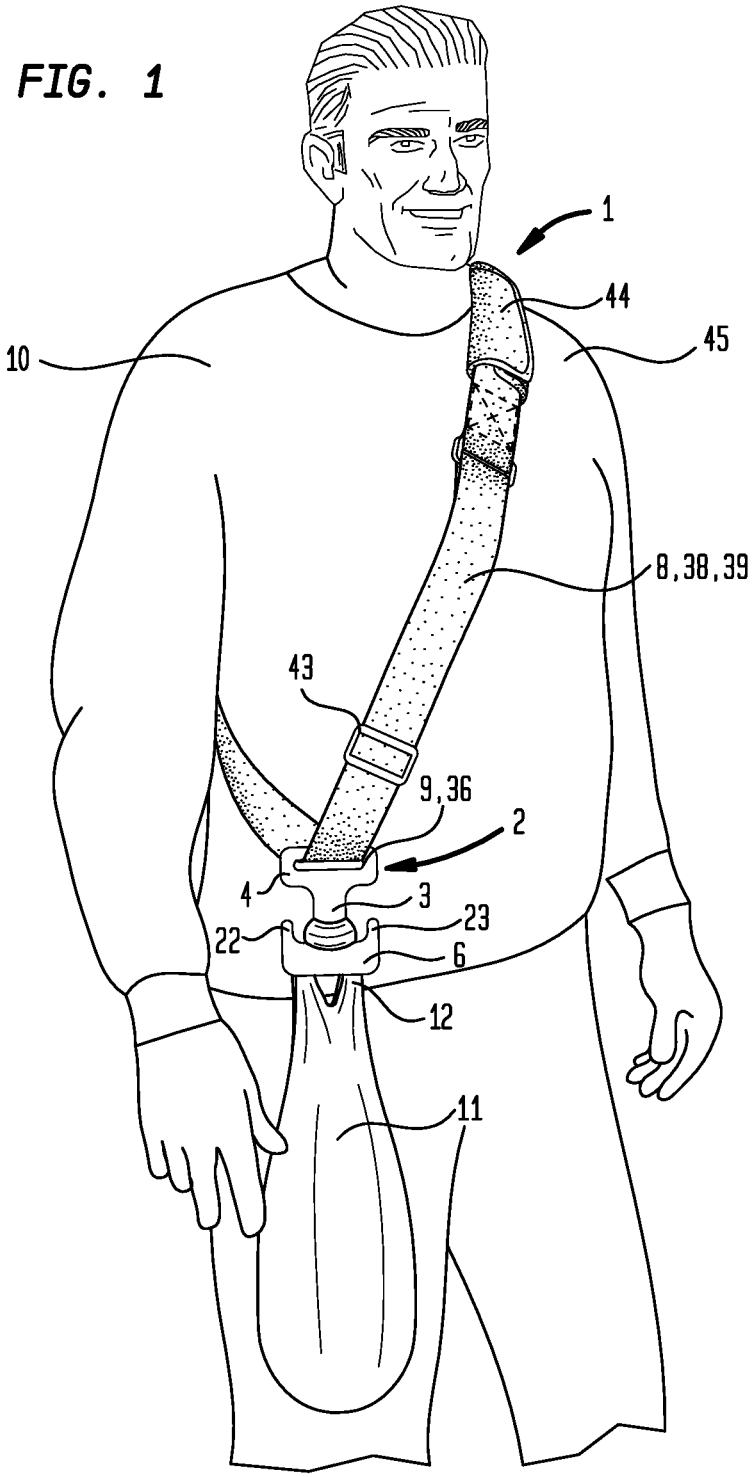
FIG. 1 is a method of using an embodiment of the device.

Now generally referring to FIGS. 1 through 10, a device (1) and methods of making and using the device including at least one hook element (2), the hook element (2) including an elongate member (3), a cross member (4) coupled to a first end (5) of the elongate member (3), and a prong element (6) coupled to a second end (7) of the elongate member (3) and at least one flexible annular member (8) passing through an aperture element (9) in the cross member (4).

Referring primarily to FIGS. 1-4, in particular methods in the device (1), the flexible annular member (8) can be supported by a part of a body (10) and one or more containers (11) can have a container handle (12) engaged with the hook element (2) to carry the containers (11).

Referring primarily to FIGS. 5 through 8, embodiments of the hook element (2) can include an elongate member (3) having an elongate member length (13) disposed between an elongate member first end (5) and an elongate member second end (7). The elongate member (3) can have an elongate member length (13) of about 1.0 inches to about 5.0 inches. In particular embodiments, the elongate member length (13) can be selected from the group including or consisting of: about 1.1 inches to about 1.5 inches, about 1.25 inches to about 1.75 inches, about 1.5 inches to about 2.0 inches, about 1.75 inches to about 2.25 inches, about 2.0 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, about 3.5 inches to about 4.0 inches, about 3.75 inches to about 4.25 inches, about 4.0 inches to about 4.5 inches, about 4.25 inches to about 4.75 inches, about 4.5 inches to about 4.9 inches, or combinations thereof.

Again, referring primarily to FIGS. 5 through 8, the elongate member (3) can be disposed in a numerous and wide variety of configurations, and while the Figures depict the elongate member (3) as a rectangular prism (14), this is not intended to preclude embodiments in which the elongate member (3) comprises one or more of: a cylinder, a hexagonal prism, an octagonal prism, or other elongate configuration.

The hook element (2) can further include a cross member (4). The first end (5) of the elongate member (3) can be medially coupled to the cross member (4). The cross member (4) can have a cross member length (15) disposed between a cross member first end (16) and a cross member second end (17). In particular embodiments, the cross member length (15) of the cross member (4) can be greater than the elongate member width (18) of the elongate member (3).

In particular embodiments, the cross member length (15) of the cross member (4) can be about 2.0 inches to about 6.0 inches. In particular embodiments, the cross member length (15) can be selected from the group including or consisting of: about 2.1 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, about 3.5 inches to about 4.0 inches, about 3.75 inches to about 4.25 inches, about 4.0 inches to about 4.5 inches, about 4.25 inches to about 4.75 inches, about 4.5 inches to about 5.0 inches, about 4.75 inches to about 5.25 inches, about 5.0 inches to about 5.5 inches, about 5.25 inches to about 5.75 inches, about 5.5 inches to about 5.9 inches, or combinations thereof.

In particular embodiments, the cross member (4) can be disposed in a numerous and wide variety of configurations, and while the Figures depict the cross member (4) as a rectangular prism (14), this is not intended to preclude embodiments configured as a cylinder, a hexagonal prism, an octagonal prism, or other elongate configuration. The edges of the cross member first end (16) and the cross member second end (17) can be arcuate or rounded. In particular embodiments, the cross member (4) can, but need not necessarily, be integrally formed with the elongate member (3) as one piece. However, in particular embodiments, the cross member (4) can be coupled to the elongate member (3) through the use of mechanical fasteners, adhesives, soldering, sintering, or other method of coupling.

Again, referring primarily to FIGS. 5 through 8, embodiments of the hook element (2) can further include a prong element (6). The elongate member second end (7) can be medially coupled to the prong element (6). The prong element (6) can have a prong element length (19) disposed between a prong element first end (20) and a prong element second end (21). The prong element length (19) of the prong element (6) can be greater than the elongate member width (18) of the elongate member (3). The prong element length (19) of the prong element (6) can be about 2.0 inches to about 6.0 inches.

In particular embodiments, the prong element length (19) can be selected from the group including or consisting of: about 2.1 inches to about 2.5 inches, about 2.25 inches to about 2.75 inches, about 2.5 inches to about 3.0 inches, about 2.75 inches to about 3.25 inches, about 3.0 inches to about 3.5 inches, about 3.25 inches to about 3.75 inches, about 3.5 inches to about 4.0 inches, about 3.75 inches to about 4.25 inches, about 4.0 inches to about 4.5 inches, about 4.25 inches to about 4.75 inches, about 4.5 inches to about 5.0 inches, about 4.75 inches to about 5.25 inches, about 5.0 inches to about 5.5 inches, about 5.25 inches to about 5.75 inches, about 5.5 inches to about 5.9 inches, or combinations thereof.

Again, referring primarily to FIGS. 5 through 8, the prong element (6) can further include a first prong (22) opposite a second prong (23). The first prong (22) can be disposed on the prong element (6) on or proximate the prong element first end (20) a distance from the elongate member (3). The second prong (23) can be disposed on or proximate the prong element second end (21) a distance from the elongate member (3). Each of the first and second prongs (22)(23) can extend outward of the prong element (6) toward the cross member (4). In particular embodiments, the first and second prongs (22)(23) can, but need not necessarily, be of substantially the same configuration and extend in mirror image relation toward the cross member (4). In particular embodiments, the first and second prongs (22)(23) can each terminate in first and second hebetated prong ends (24)(25). In particular embodiments, the first and second prongs (22)(23) can each include an inner prong edge (26) facing toward the elongate member (3) and an outer prong edge (27) facing outward of the elongate member (3). In particular embodiments, the outer prong edges (27) can be substantially linear, or linear, and can, but need not necessarily, extend toward the cross member (4) in substantially parallel relation. In particular embodiments the outer prong edges (27) can terminate in substantially the same plane as the cross member first and second ends (16)(17). In particular embodiments, one or both of the inner prong edges (26) can comprise arcuate inner prong edges (28). The arcuate inner prong edges (28) can be correspondingly disposed between the first and second prong ends (29)(30) and the prong element (6). The arcuate inner prong edges (28) can extend to the elongate member edge (31), thereby providing pinch features (32) disposed between ascending portions of the arcuate inner prong edges (28). The pinch features (32) can urge movement of the handles (12) of containers (11) disposed between the elongate member (3) and the first or second prongs (22)(23) toward the elongate member (3).

In particular embodiments, the prong element (6) can be integrally formed with the elongate member (3) as a one piece. In particular embodiments, the prong element (6) can be coupled to the elongate member (3) through the use of mechanical fasteners, adhesives, soldering, sintering, or other like method of coupling.

Again, referring primarily to FIGS. 5 through 8, particular embodiments of the hook element (2) can include an aperture element (9) disposed in the cross member (4). The aperture element (9) can communicate between the first face (33) of the cross member (4) and the second face (34) of the cross member (4). The aperture element (9) can define an aperture wall (35). In particular embodiments, as shown in FIGS. 5 through 8, the aperture element (9) can, but need not necessarily, comprise an elongate slot (36); however, this is not intended to preclude embodiments in which the aperture element (9) defines other configurations such as a circle, an oval, a square, a rectangle, or other like configuration. The aperture element (9) can include an arcuate or rounded aperture wall (37). The aperture element (9) can, but need not necessarily, be disposed centrally in the cross member (4).

The parts of the hook element (2) can comprise one or more materials, and as illustrative examples: a metal, such as, aluminum, copper, or iron; a plastic, such as, polyacrylate, methylmethacrylate, polymethylmethacrylate, polyethylene, polypropylene, polystyrene, polyvinyl chloride; wood, or combinations thereof.

Now referring primarily to FIGS. 1 through 4, particular embodiments of the device (1) can, but need not necessarily, include a first flexible annular member (38) passing through the aperture element (9) of the hook element (2). The first flexible annular member (38) can comprise a numerous and wide variety of configurations. While the configuration shown in the Figures comprises a substantially flat strap (39); this is not intended to preclude other embodiments in which the first flexible annular member (38) comprises one or more of a cord, a rope, a cable, a braid, a woven fabric, a plurality of woven cords, a webbing, or other like configuration.

The circumference of the first flexible annular member (38) can be about 2.0 feet to about 7.0 feet. In particular embodiments, the circumference of the first flexible annular member (38) can be selected from the group including or consisting of: about 2.1 feet to about 2.5 feet, about 2.25 feet to about 2.75 feet, about 2.5 feet to about 3.0 feet, about 2.75 feet to about 3.25 feet, about 3.0 feet to about 3.5 feet, about 3.25 feet to about 3.75 feet, about 3.5 feet to about 4.0 feet, about 3.75 feet to about 4.25 feet, about 4.0 feet to about 4.5 feet, about 4.25 feet to about 4.75 feet, about 4.5 feet to about 5.0 feet, about 4.75 feet to about 5.25 feet, about 5.0 feet to about 5.5 feet, about 5.25 feet to about 5.75 feet, about 5.5 feet to about 6.0 feet, about 5.75 feet to about 6.25 feet, about 6.0 feet to about 6.5 feet, about 6.25 feet to about 6.75 feet, about 6.5 feet to about 6.9 feet, or combinations thereof.

Figure 2:
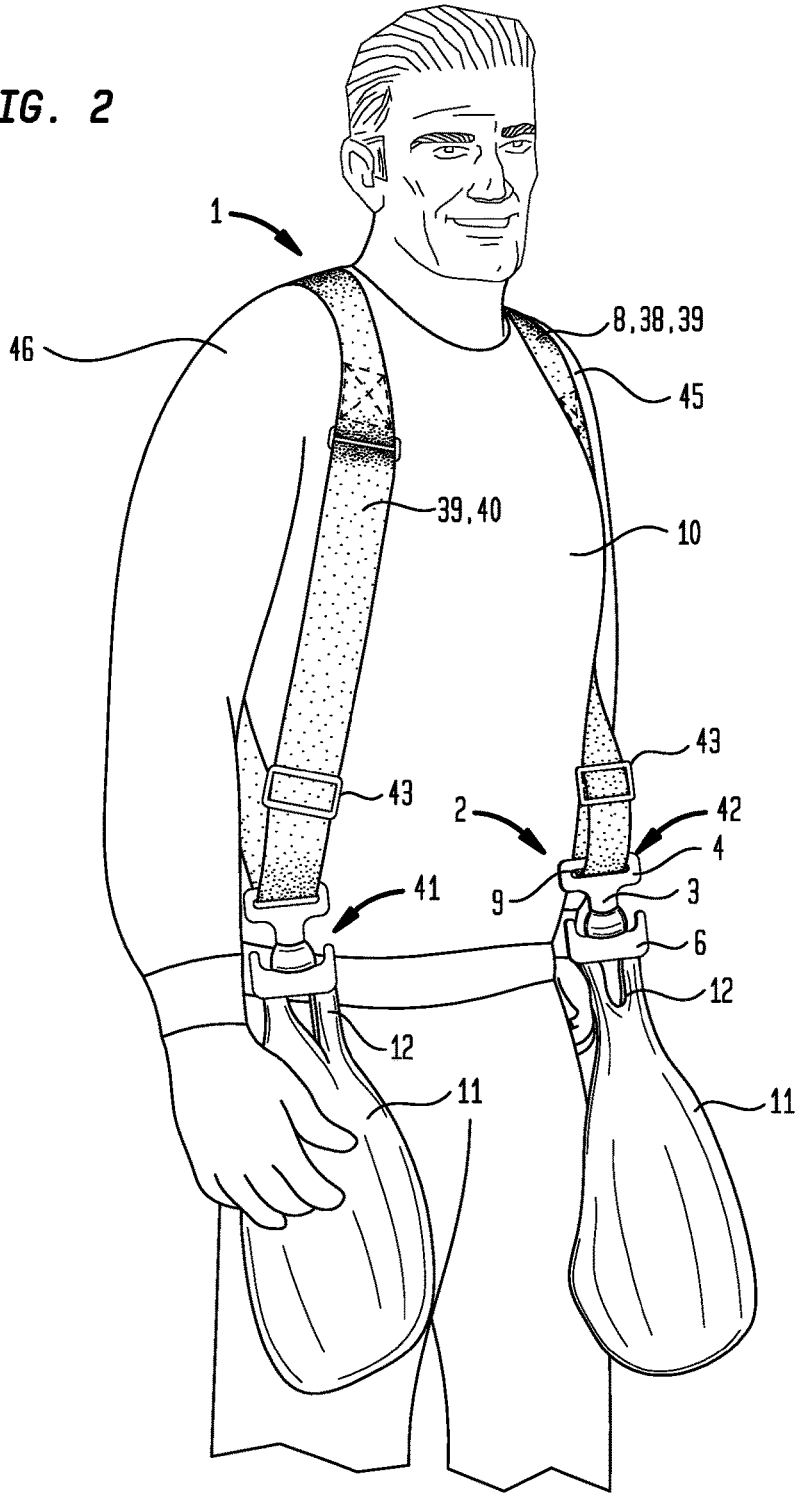
FIG. 2 is a method of using another embodiment of the device.
Figure 4:
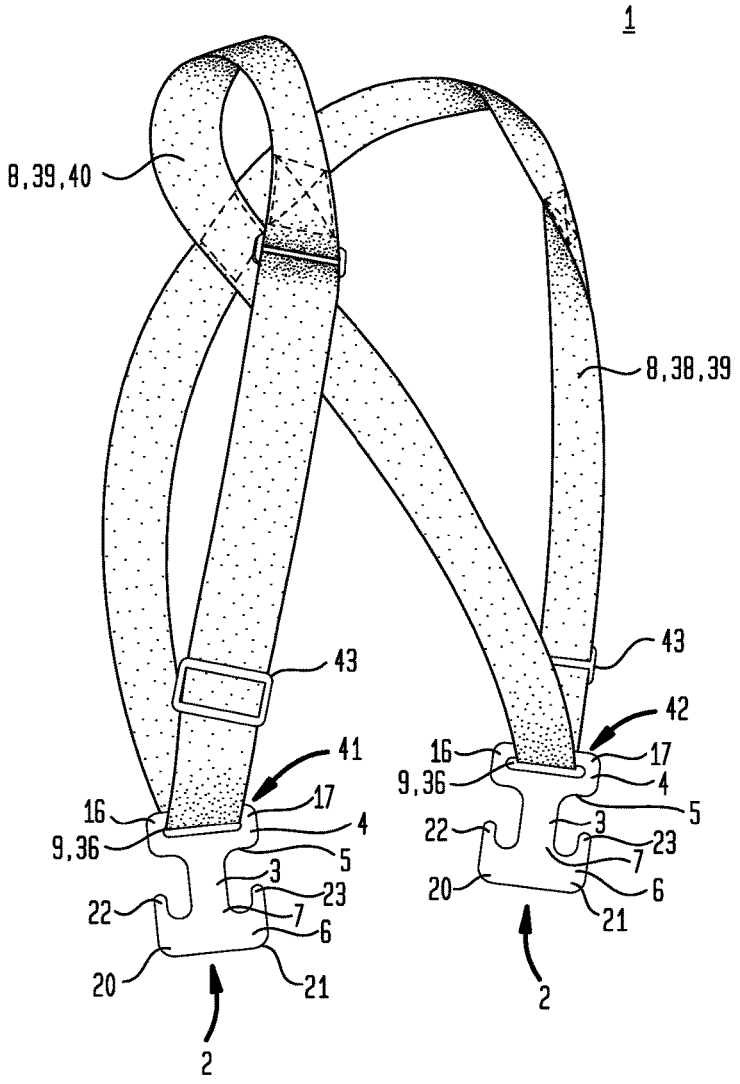
FIG. 4 is a perspective view of another embodiment of the device.
Figure 5:
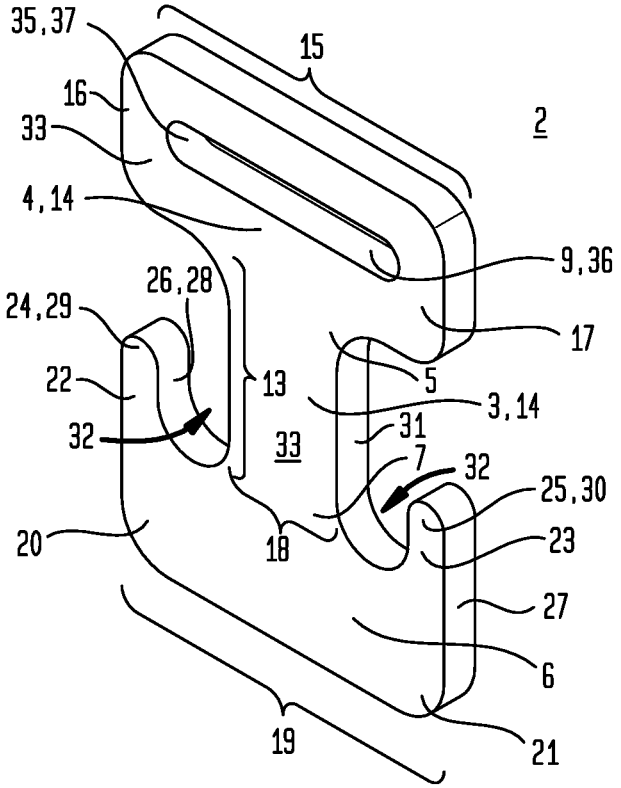
FIG. 5 is a perspective view of an embodiment of a hook element.
Figure 6:
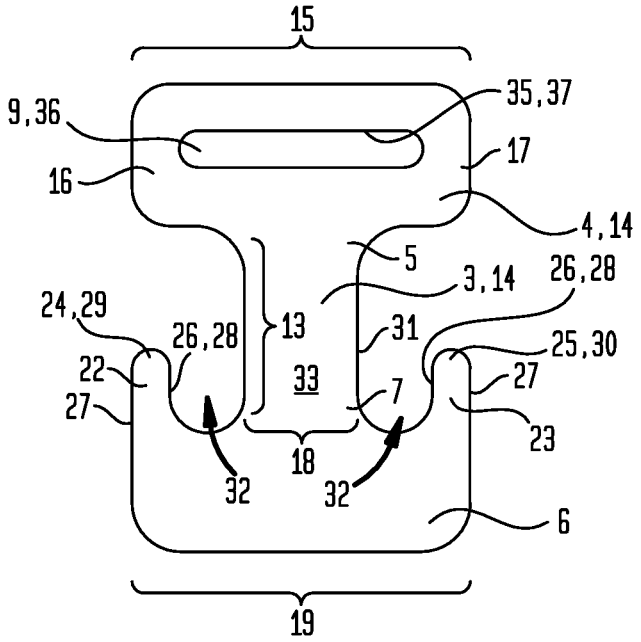
FIG. 6 is a front elevation view of an embodiment of a hook element.
Figure 7:
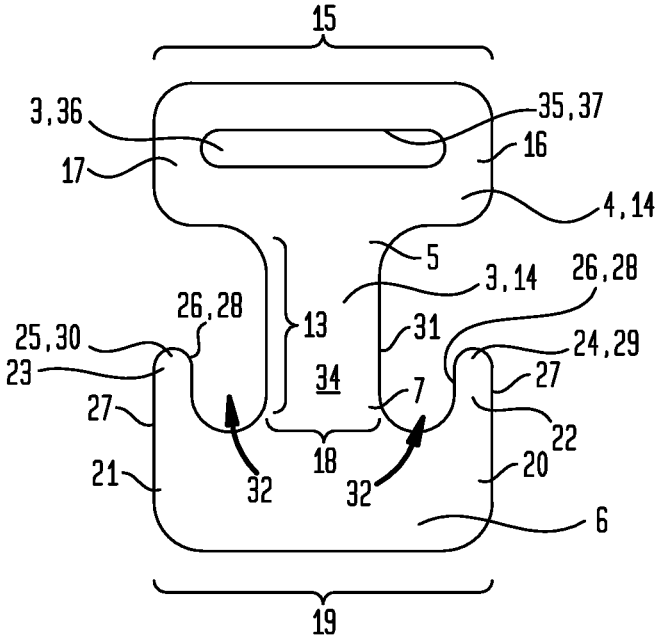
FIG. 7 is a back elevation view of an embodiment of a hook element.
Figure 8:
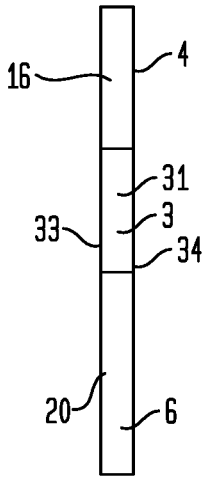
FIG. 8 is a side elevation view of an embodiment of a hook element.
Figure 9:
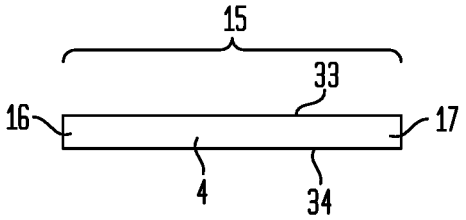
FIG. 9 is a top plan view of an embodiment of a hook element.
Figure 10:
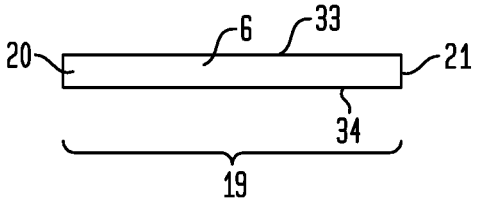
FIG. 10 is a bottom plan view of an embodiment of a hook element.

Now referring primarily to FIGS. 2 and 4, particular embodiments of the device can include a plurality of hook elements (2). Each of the plurality of hook elements (2) can include an elongate member (3), cross member (4), prong element (6), and an aperture element (9) as those elements are described above. The first flexible annular member (38) can pass through one or each of a plurality of aperture elements (9), thereby disposing one or the plurality of hook elements (2) on the first flexible annular member (38).

Now referring primarily to FIGS. 2 and 4, particular embodiments of the device (1) can, but need not necessarily, include a second flexible annular member (40). The second flexible annular member (40) can pass through at least one of the plurality of aperture elements (9) disposed on the plurality of hook elements (2). In particular embodiments, the first flexible annular member (38) can pass through a first portion (41) of the plurality of aperture elements (9) disposed on the plurality of hook elements (2), and the second flexible annular member (40) can pass through a second portion (42) of the plurality of aperture elements (9) disposed on the plurality of hook elements (2). In particular embodiments, the first flexible annular member (38) and the second flexible annular member (40) can pass through each of the plurality of aperture elements (9) disposed on the plurality of hook elements (2).

The second flexible annular member (40) can comprise a numerous and wide variety of configurations. While the configuration shown in the Figures comprises a substantially flat strap (39); this is not intended to preclude other embodiments in which the second flexible annular member (40) comprises one or more of a cord, a rope, a cable, a braid, a woven fabric, a plurality of woven cords, a webbing, or other like configuration. The circumference of the second flexible annular member (40) can be about 2.0 feet to about 7.0 feet. In particular embodiments, the circumference can be selected from the group including or consisting of: about 2.1 feet to about 2.5 feet, about 2.25 feet to about 2.75 feet, about 2.5 feet to about 3.0 feet, about 2.75 feet to about 3.25 feet, about 3.0 feet to about 3.5 feet, about 3.25 feet to about 3.75 feet, about 3.5 feet to about 4.0 feet, about 3.75 feet to about 4.25 feet, about 4.0 feet to about 4.5 feet, about 4.25 feet to about 4.75 feet, about 4.5 feet to about 5.0 feet, about 4.75 feet to about 5.25 feet, about 5.0 feet to about 5.5 feet, about 5.25 feet to about 5.75 feet, about 5.5 feet to about 6.0 feet, about 5.75 feet to about 6.25 feet, about 6.0 feet to about 6.5 feet, about 6.25 feet to about 6.75 feet, about 6.5 feet to about 6.9 feet, or combinations thereof.

The first or second flexible annular member (38)(40) can comprise one or more materials and can, as illustrative examples, be selected from the group including or consisting of: nylon, rayon, cotton, leather, vinyl, polyester, polypropylene, and combinations thereof.

Now referring primarily to FIG. 4, particular embodiments of the device (1) can include fixedly connecting the first flexible annular member (38) to the second flexible annular member (40). The first flexible annular member (38) can be fixedly connected to the second flexible annular member (40) by one or more of adhesive, mechanical fastener, interweaving a length of the first flexible annular member (38) with a length of the second flexible annular member (40), or other like method of fixedly connecting the first flexible annular member (38) to the second flexible annular member (40). The first flexible annular member (38) can pass through a first portion (41) of the plurality of aperture elements (9). The second flexible annular member (40) can pass through a second portion (42) of the plurality of aperture elements (9). The first and second portion (41)(42) can, but need not necessarily, be equivalent.

Figure 3:
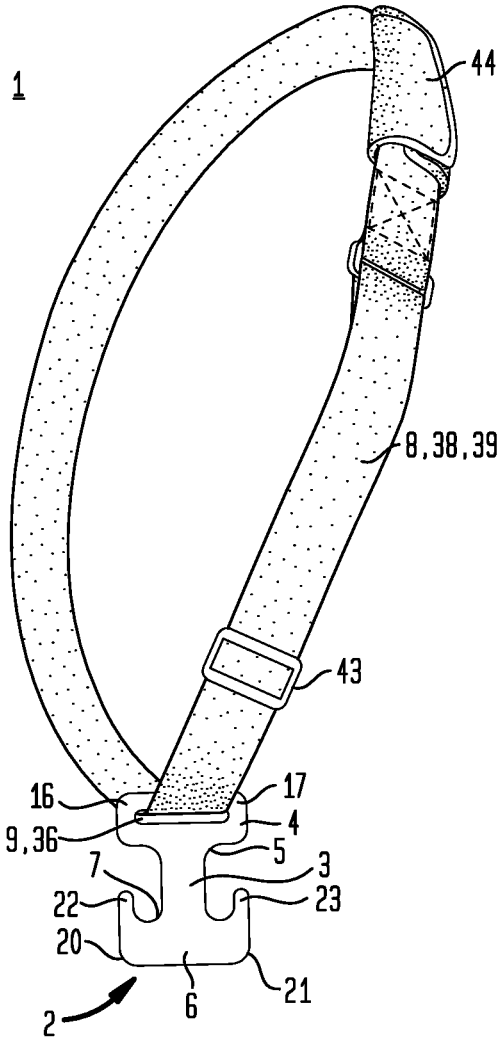
FIG. 3 is a perspective of an embodiment of the device.

Now referring primarily to FIGS. 3 and 4, embodiments of the first or second flexible annular member (38)(40) can, but need not necessarily, include an annular member length adjustment element (43) operable to adjust the circumference of the first or second flexible annular members (38)(40).

Again referring primarily to FIGS. 3 and 4, embodiments of the first or second flexible annular member (38)(40) can, but need not necessarily, include a strap pad (44) slidingly engaged about the first or second flexible annular member (38)(40).

Now referring primarily to FIGS. 1 and 2, methods in the device (1) can include obtaining at least one hook element having an elongate member (3), cross member (4), prong element (6), and an aperture element (9) disposed in the cross member (4) as described above. The method can further include passing at least one flexible annular member (8) through the aperture element (9) of one or more hook elements (2). The method can further include, supporting a first flexible annular member (38) with a part of a body; and while the illustrative examples show the first flexible annular member (38) supported by a shoulder (45) of a body (10), this is not intended to preclude supporting the first flexible annular member (38) by different parts of the body (10) or by an object not a part of the body (10). As one illustrative example, about an object not a part of the body (10) can be about the seat in a motor vehicle. The method can further include coupling, attaching or disposing a handle (12) of a container (11) to the hook element (2). In particular embodiments, the method can include disposing the handle (12) of a container (11) between the elongate member (3) and the prong element (6), and in particular embodiments, about the elongate member (3) and disposed in a pinch feature (32) of each of the first and second prongs (22)(23). The method can further include disposing a plurality of handles (12) of a plurality of containers (11) on the hook element (2). In further particular methods, the method in the device (1) can include disposing a plurality of handles (12) of a plurality of containers (11) on a plurality of hook elements (2) coupled to the first flexible annular member (38). A particular method in the device can include disposing at least one hook element (2) on a second flexible annular member (40) and disposing the second flexible annular member (40) about a part of the body (10) or an object, as above described. The method can further include fixedly connecting the first flexible annular member (38) to the second flexible annular member (40), the first flexible annular member (38) can be disposed about a first part of the body (10) or object, such as a shoulder (45) of a body (10), and the second flexible annular member (40)) can be disposed about a second part of the body (10) or object, such as a second shoulder (46) of a body (10). The first flexible annular member (38) can be coupled to a first portion (41) of a plurality of hook elements (2) and the second flexible annular member (40) can be coupled to a second portion (42) of the plurality of hook elements (2). The method can further include hooking one or more handles (12) of a plurality of containers (11) on the plurality of hook elements (2).

As can be easily understood from the foregoing, the basic concepts of the present invention may be embodied in a variety of ways. The invention involves numerous and varied embodiments of a computer implemented proactive disease state management system and methods for making and using such computer implemented proactive disease state management system including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "hook" should be understood to encompass disclosure of the act of "hooking"—whether explicitly discussed or not—and, conversely, were there effectively disclosure of the act of "hooking", such a disclosure should be understood to encompass disclosure of a "hook" or even a "means for hooking." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A device, comprising:

a hook element having a pair of flat faces sides disposed in substantially parallel opposed relation extending to a hook element periphery, each hook element including in one-piece:

a cross member having a substantially linear configuration disposed between a cross member first end and a cross member second end, said cross member having an elongate linear aperture element medially disposed in said cross member defining a passthrough configured to receive a flexible annular member;

an elongate member having an elongate member length disposed between an elongate member first end medially joined to said cross member and an elongate member second end;

a prong element having prong element length disposed between a first prong end and a second prong end, said elongate member second end medially coupled to said prong element, each of said first and second prong ends outwardly extending toward said cross member; and;

a flexible annular member slidably disposed in said passthrough defined by said aperture element disposed in said cross member.

2. The device of claim 1, further comprising at least one container having a handle disposed on said prong element.

3. The device of claim 1, wherein said prong element consists of said first and second prong ends.

4. The device of claim 1, wherein said at least one hook element comprises a plurality of hook elements.

5. The device of claim 1, wherein said first and second prong ends comprise first and second hebetated prong ends.

6. The device of claim 5, wherein each of said first and second prong ends have an arcuate prong inner face facing said elongate member.

7. The device of claim 6, wherein said hook element comprises a first hook element and a second hook element, and wherein said flexible annular member comprises a first flexible annular member and a second flexible annular member correspondingly slidably disposed in said passthrough defined by said aperture element disposed in said cross member.

8. The device of claim 7, wherein said hook element consists of said first hook element and said second hook element, and wherein said flexible annular member consists of said first flexible annular member and said second flexible annular member correspondingly slidably disposed in said passthrough defined by said aperture element disposed in said cross member.

9. The device of claim 7, wherein said first flexible annular member fixedly connected to said second flexible annular member.

10. The device of claim 9, wherein said first flexible annular member slidably disposed in a plurality of aperture elements of a first plurality of hook elements and said second flexible annular member slidably disposed in a plurality of aperture elements of a second plurality of hook elements.

11. The device of claim 10, wherein said first flexible annular member comprised of a material selected from the group consisting of: nylon, rayon, cotton, leather, vinyl, polyester, and polypropylene and combinations thereof.

12. The device of claim 11, wherein said second flexible annular member comprised of a material selected from the group consisting of: nylon, rayon, cotton, leather, vinyl, polyester, and polypropylene and combinations thereof.

13. The device of claim 12, wherein said at least one hook element comprises a material selected from the group consisting of: metal, plastic, vinyl, acrylic, polyethylene, polypropylene, polystyrene, and polyvinyl chloride, and combinations thereof.

* * * * *